United States Patent [19]

Leonard

[11] Patent Number: 4,781,611

[45] Date of Patent: Nov. 1, 1988

[54] ZERO INSERTION FORCE ELECTRICAL CONTACT ASSEMBLY

[75] Inventor: Russell J. Leonard, Downers Grove, Ill.

[73] Assignee: Molex Incorporated, Lisle, Ill.

[21] Appl. No.: 56,562

[22] Filed: Jun. 1, 1987

[51] Int. Cl.[4] ..... H01R 13/15

[52] U.S. Cl. ..... 439/259; 439/856; 439/751; 439/848

[58] Field of Search ..... 439/783, 816, 817, 823, 439/836, 837, 839, 842, 843, 844, 852, 853, 856, 857, 858, 861, 862, 863, 907, 259, 261, 262, 263, 265, 266, 268, 848, 751

[56] References Cited

U.S. PATENT DOCUMENTS

| | | | |
|---|---|---|---|
| 3,076,953 | 2/1963 | Sloop | 439/857 |
| 3,665,378 | 5/1972 | Hammell et al. | 439/857 |
| 3,846,735 | 11/1974 | Carter et al. | 439/857 |
| 4,066,327 | 1/1978 | Soes | 439/858 |
| 4,372,638 | 2/1983 | Sohler | 439/857 |

*Primary Examiner*—David Pirlot

*Attorney, Agent, or Firm*—John W. Cornell; Louis A. Hecht

[57] ABSTRACT

A zero insertion force electrical contact assembly is provided. The assembly comprises a bifurcate contact and a trifurcate contact. The bifurcate contact includes a pair of parallel contact beams cantilevered from a base. The contact beams include cam surfaces adjacent outwardly disposed portions remote from the base. The contact beams further include contact surfaces facing one another. The trifurcate contact includes a base, a central contact post extending from the base and a pair of cam arms extending from the base and on opposite sides of the contact post. Inwardly facing portions of the cam arms include converging cam surfaces. The cam arms and the contact posts are dimensioned to enable the contact arms to be disposed between the cam arms and around the contact post with little or no contact forces. Upon sufficient insertion, however, the respective camming surfaces will cause the cantilevered contact beams to be urged toward one another and into electrical contact with the contact post.

17 Claims, 2 Drawing Sheets

ZERO INSERTION FORCE ELECTRICAL CONTACT ASSEMBLY

BACKGROUND OF THE INVENTION

The present invention relates to a new and improved mating electrical contact structure characterized by zero or low mating insertion forces and by gradually increasing cam-assisted normal contact forces. More particularly, it relates to a mating electrical contact structure including opposed cantilevered double-pronged or bifurcate female contact terminal having outer cam surfaces at the free ends thereof and a triple-pronged or trifurcate male terminal having a central contact post and a pair of outer posts with cam surfaces which cooperatively engage female camming surfaces to increase the normal contact forces of the female contact portions on the central male contact post during final stages of mating.

Matable electrical contacts typically comprise a plug or male terminal and a socket or female terminal. The female terminal may define a bifurcate contact which comprises a pair of spaced apart cantilevered contact beams. Female terminals of this type frequently are referred to as tuning fork contacts. The cantilevered contact beams of the prior art bifurcate contacts typically include portions which are spaced from one another by a distance that is less than the width of the male terminal. As a result, the insertion of the male terminal between the contact beams of the prior art bifurcate contact will initially bias the contact beams of the female terminal away from one another. Conversely, the contact beams of the prior art bifurcate contact each will exert a normal force on the plug. Continued mating insertion movement of the make into the prior art bifurcate female will require the frictional forces between the contact beams and the male terminal to be overcome. Additionally, throughout this movement, the normal force between the contact beams of the prior art bifurcate contact and the male terminal will remain substantially constant.

The above described prior art combination of a bifurcate contact and a male terminal suffers several deficiencies. In particular, the normal force exerted by the contact beams of the prior art bifurcate female terminals are substantially at their maximum when the male terminal is initially inserted into the socket. These normal forces of the contact beams create a significant likelihood of damage to the small and usually fragile contact members during the initial insertion. Furthermore, the frictional force exerted during the insertion process is potentially damaging to both the male terminal and the contact beams of the prior art contact assembly. Furthermore, the typical prior art bifurcate contact and male terminal assembly maintains a substantially constant force throughout the entire insertion process. Thus, attempts to minimize the liklihood of damage at the initial stages of the insertion generally result in a less than desirable normal force between the contact beams of the female and the male terminal upon complete insertion, with a resulting detrimental effect on the quality of the electrical connection.

Many varities of zero insertion force connectors have been developed to address the above described problems associated with the insertion of a relatively fragile male terminal into a similarly fragile dual-cantilever spring arm female. The typical prior art zero insertion force connector includes a complex housing having a plurality of parts that are movable relative to one another. A plurality of female terminals typically are mounted in one member of the housing of the prior art zero insertion force connector. These female terminals are disposed to permit the male pin terminals to be fully seated in the housing without contacting the corresponding sockets. An actuator of the housing then is moved to urge the male and female terminals into a secure electrical connection with one another. Although prior art zero insertion force connectors work extremely well, these types of connectors tend to be relatively complex and expensive.

In view of the above, it is an object of the subject invention to provide a mating electrical contact structure that achieves a secure electrical connection with little or no insertion force exerted upon either contact.

Another object of the subject invention is to provide a mating electrical contact structure that achieves high normal forces with little likelihood of damage occurring during insertion.

SUMMARY OF THE INVENTION

The subject invention is directed to a mating electrical contact structure characterized by zero insertion forces and gradually increasing normal forces as the contacts are inserted to their mated condition. Furthermore, the pair of matable electrical contacts achieve the high normal force in their mated condition without movable parts in their respective housings, as in the typical prior art zero insertion force connector.

The mating electrical contact structure of the subject invention comprises a bifurcate female terminal of the general type typically referred to as a tuning fork contact and a trifurcate male terminal member including a central male contact post and a pair of cam arms disposed on opposite sides of the central contact post.

The bifurcate female terminal comprises a base and a pair of cantilevered contact beams that may be generally parallel to one another. The contact beams of the bifurcate female each include a cam surface. The cam surfaces of the bifurcate female may be disposed on the portions of each contact beam most distant from the base and on the outwardly facing sides thereof. As will be explained further below, the cam surfaces of each contact beam on the bifurcate female enable the respective contact beams to be urged toward one another. The angle of the respective cam surfaces relative to the longitudinal direction of the respective contact beams defines both the magnitude and rate of movement of the contact beams and the magnitude of the normal force that can be applied by the contact beams.

The bifurcate female terminal may further comprise a solder tail extending from a selected location on the base. Typically, the solder tail will extend in a direction generally opposite the contact beams. The base may further be provided with mounting means to enable the bifurcate contact to be securely mounted to a housing. For example, the base may be provided with at least one locking barb which can be force fit into an appropriately dimensioned aperture of a housing. Selected portions of the base may be coated with an insulating material, thereby making the base of the bifurcate contact well suited for mounting on the surface of a circuit board, a housing or the like.

The trifurcate male terminal may comprise a base from which the central contact post extends. The central contact post may have a width approximately equal to or slightly less than the distance between the contact beams of the bifurcate female terminal. The trifurcate male terminal may also include a pair of cam arms which extend from the base thereof. The inwardly facing edges of the cam arms at locations thereon remote from the base may be spaced from one another by a distance which is equal to or slightly greater than the distance between the outwardly facing edges of the contact beams on the bifurcate female contact. Preferably, the inwardly facing edges of the cam arms remote from the base are parallel to one another. However, the inwardly facing surfaces of the cam arms include cam surfaces which converge toward the central contact post of the trifurcate male terminal at locations closer to the base. Thus, the inwardly facing cam surfaces of the cam arms are furthest from one another at locations remote from the base and are closest to one another at locations nearer the base. Preferably, the angle defined by the cam surfaces of the cam arms on the trifurcate male terminal substantially equals the angles defined by the cam surfaces of the contact beams on the bifurcate female terminal.

The cam arms preferably each have a greater length than the central post of the trifurcate male contact. Additionally, the distance between the base of the bifurcate contact and the cam surfaces thereon is greater than the distances between the free ends of the cam arms of the trifurcate contact and the cam surfaces thereof.

In use, the cam arms of the trifurcate male terminal may effectively telescope over the contact beams of the bifurcate female terminal with no normal force and with little or no frictional force therebetween. Additionally, the cam arms of the trifurcate contact will guide the central male contact post thereof between the contact beams of the bifurcate female contact with no normal or frictional forces between the central contact post and the contact beams. As the trifurcate contact approaches its fully seated condition relative to the bifurcate contact, the cam surfaces of the cam arms will contact the cam surfaces of the contact beams. Continued movement of the trifurcate and bifurcate contacts toward one another will cause a cam action between the respective cam surfaces. The effect of this cam action will urge the contact beams of the bifurcate contact toward one another and into secure electrical contact with the central contact post of the trifurcate contact. Furthermore, the contact beam will be tightly retained in electrical contact on both its inner and outer sides, thereby assuring a good electrical connection. The magnitude of the normal forces between the contact beams and the central contact post will depend upon the depth of insertion enabled by the contacts and/or their housings, and will further depend on the relative angles and lengths of the cam surfaces thereof. In all embodiments, however, the contact beams can achieve the required normal force against the central contact post of the trifurcate contact without an initial force and without the benefit of a complex housing having various movable members.

The resulting mating electrical contact structure results in an extremely reliable four-point redundant electrical contact between the mating female and male terminals of this invention. Wiping electrical contact is achieved at each pair of camming surfaces on the male and female terminals, respectively. In addition, both of the contact beams of the female terminal exert a loaded high pressure normal contact force on opposed sides of the central post of the male terminal.

DETAILED DESCRIPTION OF THE PREFERRED EMBODIMENTS

Figure 1:
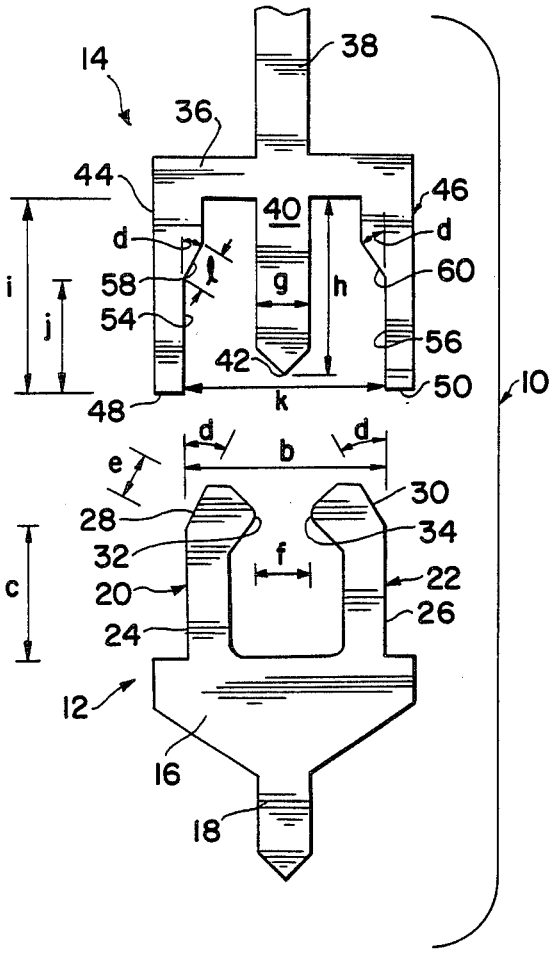
FIG. 1 is a front elevational view of the contacts of the subject invention.
Figure 2:
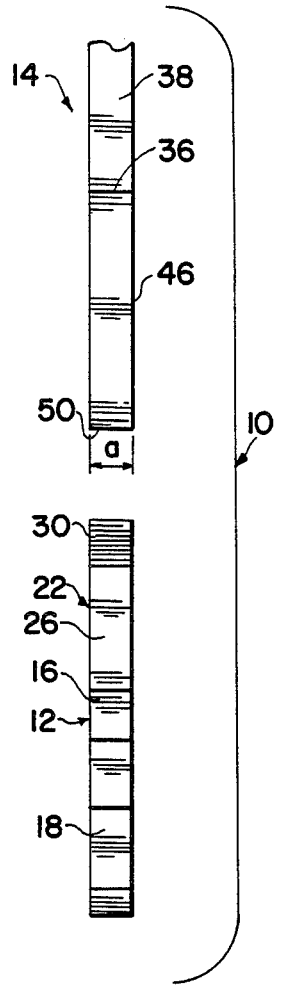
FIG. 2 is a side elevational view of the contacts shown in FIG. 1.
Figure 3:
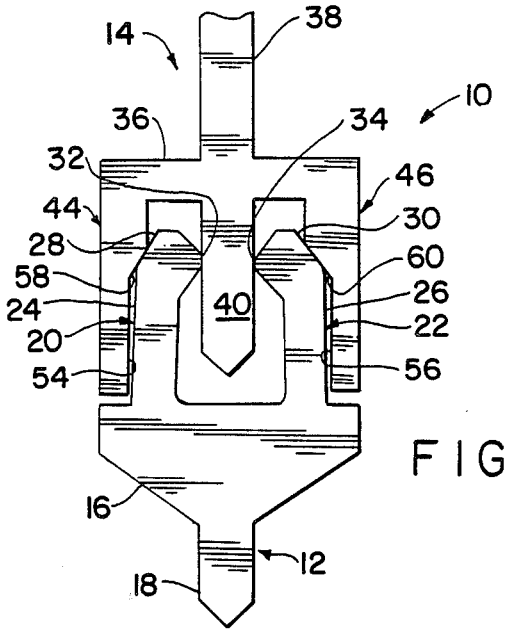
FIG. 3 is a front elevational view of the contacts of the subject invention in a mated condition.

The mating electrical contact structure of the subject invention is identified generally by the numeral 10 in FIGS. 1–3. The mating contact structure 10 comprises a bifurcate female terminal 12 and a trifurcate male terminal 14. The bifurcate female terminal 12 defines a female socket generally referred to as a tuning fork socket. The bifurcate contact 12 and the trifurcate contact 14 are of generally planar construction as shown most clearly in FIG. 2, and are stamp formed from unitary pieces of an electrically conductive material having a thickness "a" of approximately 0.008 inch. In accordance with standard industry practice well known to the person skilled in this art, bifurcate female terminal 12 and the trifurcate male terminal 14 typically will be stamped and coined to extend integrally from respective carrier strips. The respective carrier strips may be reelable and may include indexing apertures in accordance with standard practice.

The bifurcate contact 12 includes a base 16 and a solder tail 18 extending from the base 16. As depicted in FIG. 1, the base 16 and the solder tail 18 are symmetrical. However, such symmetry is not required, and the particular configuration of the base 16 and solder tail 18 will depend entirely upon the application in which the bifurcate contact 12 is employed. Moreover, although a solder tail 18 is shown, other contact structures for electrically connecting the bifurcate female terminal to another circuit member may extend from the base 16 as will be readily apparent to those skilled in this art.

The bifurcate contact 12 further comprises contact beams 20 and 22 which are cantilevered from the base 16 and are disposed in generally spaced parallel relationship to one another. The contact beams 20 and 22 are defined in part by generally planar outer surfaces 24 and 26 respectively which are substantially perpendicular to the base 12 and are spaced from one another by distance "b", and which have respective lengths "c" as measured from the base 16. The contact beams 20 and 22 further comprise cam surfaces 28 and 30 respectively which are disposed at the ends of the contact beams 20 and 22 most distant from the base 16 and which intersect the outer surfaces 24 and 26 respectively at angles "d". More particularly, the cam surfaces 28 and 30 are angularly aligned to converge toward one another at greater distances from the base 16. The magnitude of angle "d" and the length "e" of the cam surfaces will in part determine the camming characteristics of the bifurcate contact 12 as explained further below. The contact beams 20 and 22 further comprise arcuate contact surfaces 32 and 34 which are disposed on the inwardly facing sides of the contact arms 20 and 22 and which are arced convexly toward one another. The contact surfaces 32 and 34 are spaced from one another by dimension "f".

The trifurcate male terminal 14 includes a generally elongated base 36 and a solder tail 38. Once again, the base 36 and solder tail 38 are depicted in FIG. 1 as being generally symmetrical, but such symmetry is not required. Again, although a solder tail contact 38 is shown, other contact structures for electrically connecting male terminal 14 to another circuit member may be used. The trifurcate male terminal 14 further comprises a central elongated contact post 40 having a width "g" which is less than the distance "f" between the contact surfaces 32 and 34 on the bifurcate contact 12. The contact post 40 extends from the base 36 a distance "h" and preferably terminates at a tapered end 42.

The trifurcate contact 14 further comprises cam arms 44 and 46 which extend substantially orthogonally from the base 36 and are disposed respectively on opposite sides of the contact post 40. More particularly, the cam arms 44 and 46 extend from the base 36 a distance "i" which is greater than the length "h" of the contact post 40. The cam arms 44 and 46 include ends 48 and 50 respectively and inner surfaces 54 and 56 respectively which are generally parallel and facing one another. The inner surfaces 54 and 56 extend from the ends 48, 50 for a distance "j" toward the base 36. The length "j" of the inner surfaces 54 and 56 is less than the length "c" of the outer surfaces 24 and 26 of the contact beams 20 and 22 on the bifurcate female terminal 12. Additionally, the inner surfaces 54 and 56 are spaced from one another by distance "k" which is slightly greater than the distance "b" between the outer surfaces 24 and 26 of the contact beams 20 and 22 on bifurcate contact 12.

The cam arms 44 and 46 further include cam surfaces 58 and 60 which extend from the inner surfaces 54 and 56 and converge toward one another at distances closer to the base 36. More particularly, the cam surfaces 58 and 60 define angles "d" relative to the inner surfaces 54 and 56 which are substantially equal to the angles defined by the cam surfaces 28 and 30 relative to the outer surfaces 24 and 26 on the bifurcate contact 12.

The bifurcate contact 12 and the trifurcate contact 14 are connected as shown in FIG. 3. More particularly, the connection between the bifurcate contact 12 and the trifurcate contact 14 is achieved by advancing the contacts toward one another along lines generally parallel to the contact beams 20 and 22 and the cam arms 44 and 46. The cam surfaces 28 and 30 of the contact beams 20 and 22 on the bifurcate female 12 will guide the contact beams 20 and 22 between the cam arms 44 and 46 of the trifurcate contact 14. As explained previously, the distance "k" between the inner surfaces 54 and 56 of the cam arms 44 and 46 on the trifurcate contact 14 is slightly greater than the distance "b" between the outer surfaces 24 and 26 on the contact beams 20 and 22 of the bifurcate contact 12. Additionally, the distance "f" between the contact surfaces 32 and 34 of the contact beams 20 and 22 is slightly greater than the width "g" of the central contact post 40 on the trifurcate contact 14. As a result, the initial movement of the contact beams 20 and 22 on the bifurcate contact 12 into the trifurcate contact 14 will be made virtually effortlessly. More particularly, the contact beams 20 and 22 will not have to overcome an initial normal force to move around the central contact post 40 of the trifurcate contact 14, and there will be virtually zero frictional force throughout this movement of the contact beams 20 and 22 along the central contact post 40.

As noted above, the length "c" of the outer surfaces 24 and 26 of contact beams 20 and 22 is slightly greater than the length "j" of the inner surfaces 54 and 56 of cam arms 44 and 46. As a result, at some point during the movement of the bifurcate contact 12 and the trifurcate contact 14 toward one another, the cam surfaces 28 and 30 of the bifurcate contact 12 will contact the cam surfaces 58 and 60 of the trifurcate contact 14. This interaction between the cam surfaces 28, 30 and 58, 60 will cause the cantilevered contact beams 20 and 22 of the bifurcate contact 12 to be urged inwardly toward one another. This pivoting movement of the contact beams 20 and 22 toward one another will cause the distance between the contact surfaces 32 and 34 to become less than the initial distance "f". Once this distance between the contact surfaces 32 and 34 decreases to distance "g", the contact surfaces 32 and 34 will make mechanical and electrical connection with the respective opposite sides of the contact post 40 of the trifurcate contact 14. Each contact beam 20 and 22 will thus electrically connect with both the central contact post 40 and the cam arms 44 and 46 to achieve a secure mechanical connection and a redundant electrical connection.

The normal force between the contact surfaces 32 and 34 and the contact post 40 will depend upon several factors including the angle "d" of the respective cam surfaces 28, 30, 58 and 60, the respective lengths "e" and "l" of the cam surfaces 28, 30, 58 and 60, and the relative amount of axial movement of the contacts 12 and 14 that can take place after the initial engagement of the respective cam surfaces 28, 30, 58 and 60. The magnitude of this axial movement after the initial engagement of the cam surfaces 28, 30, 58 and 60 is dependent in part upon the difference between the length "c" of the outer surfaces 24 and 26 on the contact beams 20 and 22 and the length "j" of the inner surfaces 54 and 56 on the cam arms 44 and 46. In all situations, however, the initial movement of the bifurcate contact 12 and the trifurcate contact 14 toward one another will be virtually effortless, and no normal forces will be created until the very end of the insertion when the respective cam surfaces 28 and 30 of the bifurcate contact 12 engage the cam surfaces 58 and 60 of the trifurcate contact 14. Furthermore, in virtually all instances, the respective angles "d" of the cam surfaces 28, 30, 58 and 60 can be selected to achieve the desired and/or required normal forces between the contact beams 20, 22 and the contact post 40.

Figure 4:
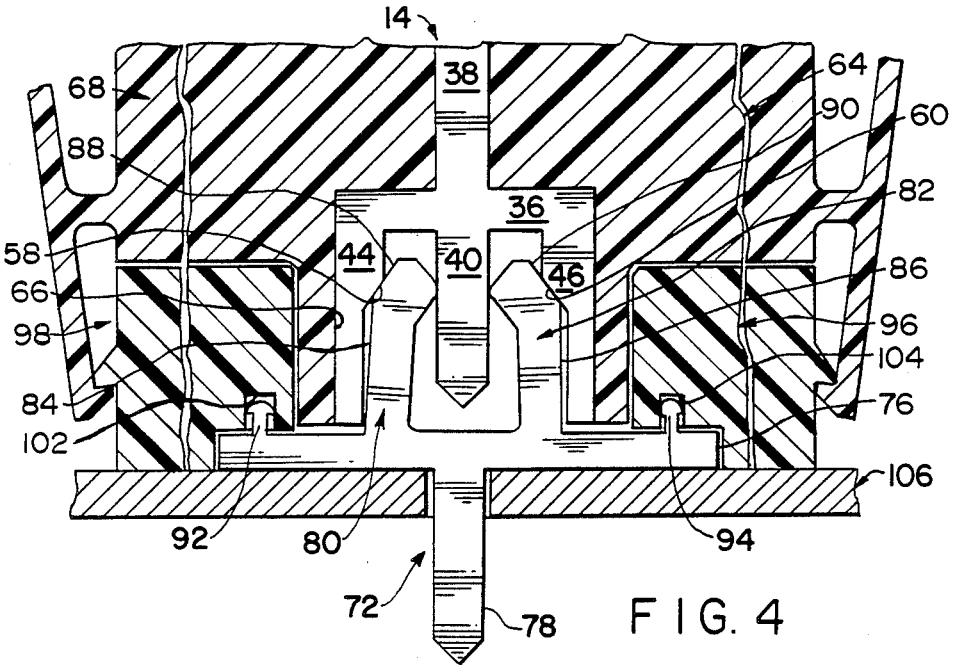
FIG. 4 is a cross-sectional view showing an alternate embodiment of the contacts mounted in a housing.

FIG. 4 shows a slightly different embodiment of the subject invention. More particularly, the pair of contacts shown in FIG. 4 comprises a trifurcate contact 14 substantially identical to the trifurcate male terminal illustrated in FIGS. 1–3. In particular, the trifurcate contact 14 includes a base 36, a solder tail 38 extending from the base 36, a contact post 40 extending from an opposite side of the base 36 and a pair of cam arms 44 and 46 extending from the base 36 on opposite sides of the contact post 40. However, as illustrated in FIG. 4, the trifurcate contact 14 is securely mounted in a housing 64. In particular, the housing 64 is provided with a mounting aperture 66 which is dimensioned to receive the trifurcate contact 14 such that the cam arms 44 and 46 are prevented from being biased away from one another. In the typical embodiment, a generally parallel array of trifurcate male terminals 14 will be mounted in the housing 64 to define male connector 68. The trifurcate male terminals 14 preferably are mass inserted into the housing 64, and may be press fit, with positive retention achieved by barbs (not shown). Alternatively, a dielectric carrier insert may be molded to a parallel array of trifurcate male terminals 14 to provide an alignment and mounting subassembly. This alignment and mounting subassembly, in turn, may be received in a connector housing similar to the housing 64 illustrated in FIG. 4.

The pair of contacts shown in FIG. 4 further comprises a bifurcate female terminal 72 which is similar to the bifurcate female terminal 12 described above and illustrated in FIGS. 1–3. The bifurcate female terminal 72 includes a base 76 having a solder tail 78 extending therefrom. A pair of contact beams 80 and 82 extend from the base 76 and are substantially identical to the contact beams 20 and 22 described above. In particular, the contact beams 80 and 82 include generally parallel outer surfaces 84 and 86 and cam surfaces 88 and 90 as illustrated in FIG. 4. The bifurcate female terminal 72 further comprises a pair of locking barbs 92 and 94 which extend from the base 76 on opposite sides of the contact beams 80 and 82.

A plurality of bifurcate female terminals 72 are mounted in a housing 96 to define a female connector 98 which is dimensioned and configured to mate with the male connector 68. The housing 96 is provided with locking apertures 102 and 104 which are dimensioned to securely receive the locking barbs 92 and 94 respectively of the bifurcate female terminal 72. The female connector 98 comprising the housing 96 and the plurality of bifurcate female terminals 72 may be mounted on a circuit board 106 as shown in FIG. 4. The male connector 68 and the female connector 98 may be assembled into the mated condition as shown in FIG. 4. More particularly, the respective housings 64 and 96 will ensure that the contact beams 80 and 82 will move between the cam arms 44 and 46 with little or no initial force therebetween. As the male and female connectors 68 and 98 approach the fully seated condition, however, the cam surfaces 88 and 90 of the bifurcate female terminal 72 will engage the cam surfaces 58 and 60 of the trifurcate male terminal 14. The housing 64 will positively prevent the cam arms 44 and 46 of the trifurcate male terminal 14 from moving outwardly and away from one another. As a result, the contact beams 80 and 82 of the bifurcate female terminal 72 will be urged toward one another by the camming action, and will be urged into the contact post 40. As a result, an extremely reliable four-point redundant electrical contact will be achieved between the mated trifurcate male terminals 14 and the bifurcate female terminals 72. This four-point contact comprises the wiping electrical contact between the respective cam surfaces and the normal contact against the opposed sides of the contact post 40. Furthermore, as shown in FIG. 4, the normal forces between the contact beams 80 and 82 and the contact post 40 will reach desirably high levels during final stages of mating. The male and female connectors 68 and 90 may be retained in their locked condition by an appropriate cooperative latch assembly as shown in FIG. 4.

In summary, a zero insertion force electrical contact assembly is provided, including a bifurcate female terminal or contact and a trifurcate male terminal or contact. The bifurcate female terminal includes a base having a pair of spaced apart generally parallel contact beams cantilevered therefrom. The contact beams include generally parallel outer surfaces and converging cam surfaces extending from the outer surfaces on respective locations along the contact beams remote from the base. The contact beams further are provided with contact surfaces on inwardly facing portions. The trifurcate male terminal includes a base from which a central contact post extends. A pair of cam arms extend from the base of the trifurcate contact and are disposed in parallel relationship on opposite sides of the contact post. The cam arms include generally parallel inwardly facing surfaces and inwardly facing cam surfaces disposed in proximity to the base and converging toward one another at closer distances to the base. The relative dimensions of the bifurcate and trifurcate contacts enable the contact beams to be initially inserted between the cam arms of the trifurcate contact and around the contact post thereof with little or no actual contact. However, upon sufficient insertion, the cam surfaces of the contact beams will engage the cam surfaces of the trifurcate contact. As a result of this camming action, the cantilevered contact beams will be urged toward one another and into secure electrical engagement with the central contact post of the trifurcate contact. The magnitude of the normal forces created between the contact beams and both the respective cam arms and the contact post will depend upon the dimensions and angles of the cam surfaces.

While the invention has been described with respect to certain preferred embodiments, it is apparent that various changes can be made without departing from the scope of the invention as defined by the appended claims.

I claim:

1. A zero insertion force mating electrical contact structure comprising:

a bifurcate female terminal comprising a base and a pair of contact beams cantilevered from said base, said contact beams including generally inwardly facing contact surfaces and generally outwardly facing cam surfaces converging toward one another at greater distances from said base; and a trifurcate male terminal comprising a base, a central contact post extending from said base, said central contact post having a width less than or equal to the distance between said contact surfaces of said contact beams, said trifurcate male terminal further comprising a pair of cam arms extending from said base and on opposite sides of said contact post, said cam arms comprising generally inwardly facing cam surfaces converging toward one another at closer distances to said base, said cam surfaces of said trifurcate male terminal being disposed to engage the cam surfaces of said bifurcate female terminal upon sufficient movement of the male and female terminals toward one another, and to urge the contact surfaces of said bifurcate female terminal into engagement with the central contact post of said trifurcate male terminal.

2. The mating contact structure as in claim 1 wherein the length of the cam arms of the trifurcate male terminal is greater than the length of the contact post.

3. The mating contact structure as in claim 1 wherein the female terminal and male terminal each further comprise a solder tail.

4. The mating contact structure as in claim 1 wherein the contact beams of said bifurcate female terminal include substantially parallel outwardly facing outer surfaces intermediate the base and the respective cam surfaces of said bifurcate female terminal and wherein the cam arms of said trifurcate male terminal include inwardly facing parallel inner surfaces disposed such that the cam surfaces of said trifurcate male terminal are disposed intermediate the base and the respective inner surfaces thereof, the distance between the inner surfaces of said trifurcate male terminal being equal to or greater than the width defined by the outer substantially parallel surfaces of said contact beams of said bifurcate female terminal.

5. The mating contact structure as in claim 4 wherein the length of the outer surfaces of the contact beams measured from the base of said bifurcate female terminal is greater than the length of said parallel inner surfaces of said cam arms measured from the cam surfaces of said trifurcate male terminal.

6. The mating contact structure as in claim 4 wherein the angle between the cam surface of one contact beam and the corresponding outer surface thereof is substantially equal to the angle between the cam surface of the other contact beam and the corresponding outer surface thereof.

7. The mating contact structure as in claim 6 wherein the angle between the cam surface of one said cam arm of said trifurcate male terminal and the corresponding inner surface thereof is substantially equal to the angle between the cam surface of the other cam arm and the corresponding inner surface thereof.

8. The mating contact structure as in claim 7 wherein the angles between the cam surfaces of said contact beams and the associated outer surfaces thereof substantially equal the angles of said cam surfaces of said cam arms to the respective inner surfaces thereof.

9. The mating contact structure as in claim 1 further comprising a housing for said trifurcate male terminal, said housing substantially retaining said cam arms to prevent movement of said cam arms away from one another such that the engagement of the cam surfaces of said bifurcate female terminal with the cam surfaces of the male terminal will urge the contact beams of the female terminal toward one another.

10. A mating contact structure as in claim 9 further comprising means for locking said bifurcate female terminal into engagement with said trifurcate male terminal.

11. A zero insertion force electrical contact assembly comprising:

a bifurcate contact comprising a base, a pair of generally parallel cantilevered contact beams extending from said base, said contact beams each including a pair of inwardly facing generally arcuate contact surfaces and a pair of outwardly facing substantially parallel outer surfaces extending from said base, said contact beams further comprising cam surfaces extending from the respective outer surfaces thereof and converging toward one another at greater distances from said base; and a trifurcate contact comprising a base, a central contact post extending from said base, said central contact post having a width less than the distance between the contact surfaces of said contact beams, said trifurcate contact further comprising a pair of generally parallel cam arms disposed symmetrically on opposite sides of said contact post and extending from said base, said contact arms comprising inwardly facing substantially parallel inner surfaces spaced from one another a distance greater than the width defined by the substantially parallel outer surfaces of said contact beams, said cam arms further comprising generally inwardly facing cam surfaces disposed intermediate the respective inner surfaces of said cam arms and said base and converging toward one another at closer distances to said base, whereby said contact beams of said bifurcate contact can be initially inserted between the cam arms of said trifurcate contact and on opposite sides of the central contact post thereof with a substantially zero insertion force, and whereby said cam surfaces of said bifurcate contact engage the cam surfaces of said trifurcate contact upon sufficient insertion to urge said contact surfaces into said central contact post.

12. A contact assembly as in claim 11 further comprising housing means for preventing the cam arms of said trifurcate contact from moving away from one another.

13. A contact assembly as in claim 11 further comprising means for retaining said contacts in an assembled condition.

14. A contact assembly as in claim 11 wherein said bifurcate and trifurcate contacts each comprise a solder tail.

15. A zero insertion force electrical contact assembly comprising:

a trifurcate contact stamp formed from a unitary piece of electrically conductive material, said trifurcate contact comprising a central contact post and a pair of cam arms disposed on opposite sides of said central contact post, said cam arms each including inwardly facing cam surfaces; and a bifurcate contact stamp formed from a unitary piece of electrically conductive material, said bifurcate contact comprising a pair of contact beams spaced from one another a sufficient distance to enable said contact beams to pass on opposite sides of said central contact post with substantially no normal force therebetween, said contact beams further comprising generally outwardly facing cam surfaces disposed and dimensioned to engage the inwardly facing cam surfaces of said trifurcate contact, whereby the engagement of the respective cam surfaces of the bifurcate and trifurcate contacts will urge the contact beams of said bifurcate contact toward one another and into engagement with the central contact post of the trifurcate contact.

16. A contact assembly as in claim 15 further comprising housing means for preventing the movement of the cam arms of the trifurcate contact away from one another.

17. A contact assembly as in claim 15 further comprising means for retaining the bifurcate and trifurcate contacts in an assembled condition.

* * * * *